US006015549A

United States Patent [19]

Cowperthwaite et al.

[11] Patent Number: 6,015,549

[45] Date of Patent: Jan. 18, 2000

[54] METHOD OF PROMOTING ADHESION TO KERATINACEOUS SURFACE, USE OF SAME IN RESHAPING SURFACE, AND KIT THEREFOR

[75] Inventors: George F. Cowperthwaite, Coatesville; Allen D. Johnston, West Chester, both of Pa.; Susan C. Sheariss, Swedesboro, N.J.

[73] Assignee: Esschem, Inc., Linwood, Pa.

[21] Appl. No.: 09/061,948

[22] Filed: Apr. 17, 1998

[51] Int. Cl.[7] ..... A61K 6/00; A61K 7/00; A61K 7/04

[52] U.S. Cl. ..... 424/61; 424/401

[58] Field of Search ..... 424/401, 61

[56] References Cited

U.S. PATENT DOCUMENTS

| | | |
|---|---|---|
| 3,347,954 | 10/1967 | Bredereck et al. . |
| 4,209,604 | 6/1980 | Werber . |
| 4,288,221 | 9/1981 | Engel . |
| 4,387,240 | 6/1983 | Berg . |
| 4,413,108 | 11/1983 | Janssen . |
| 4,521,550 | 6/1985 | Bowen . |
| 4,521,560 | 6/1985 | Breitenfellner . |
| 4,534,839 | 8/1985 | Schaefer . |
| 4,547,363 | 10/1985 | Joos . |
| 4,576,976 | 3/1986 | Schaefer . |
| 4,602,912 | 7/1986 | de Sousa et al. . |
| 4,766,005 | 8/1988 | Montgomery et al. ..... 427/4 |
| 5,264,513 | 11/1993 | Ikemura et al. . |

FOREIGN PATENT DOCUMENTS

| | | |
|---|---|---|
| 0325038 | 7/1989 | European Pat. Off. . |
| 2557536 | 7/1976 | Germany . |

OTHER PUBLICATIONS

Schumacher et al, *Dent. Mater.* 8:278 (1992) (abstract).
Venz et al, *J. Dent. Res.* 72:582 (1993) (abstract).

*Primary Examiner*—Thurman K. Page
*Assistant Examiner*—Sharon Howard

[57] ABSTRACT

A method for improving—with an adhesion-promoting composition—adhesion of a synthetic monomeric or polymeric material (such as a curable acrylic monomer/polymerized acrylic system) to a keratinaceous substrate, as in, for example, the reshaping of fingernails or toenails. The adhesion-promoting composition comprises (A) an organic, dipolar, aprotic liquid carrier and, uniformly distributed throughout said liquid carrier, (B) pyromellitic dianhydride glycerol dimethacrylate adduct ("PMGDM"). The PMGDM isomer mixture which typically results when pyromellitic dianhydride is reacted with glycerol dimethacrylate is preferred, particularly in view of its high solubility in solvents of relatively low toxicity (e.g. lower aliphatic ketones). The adhesion-promoting composition can, if desired, be included in a nail-reshaping kit containing the materials and implements needed to reshape the nail plate.

16 Claims, No Drawings

METHOD OF PROMOTING ADHESION TO KERATINACEOUS SURFACE, USE OF SAME IN RESHAPING SURFACE, AND KIT THEREFOR

CROSS REFERENCE TO RELATED APPLICATION

This application is copending with a technologically related application Ser. No. 09/010,261, filed Jan. 21, 1998, the entire disclosure of which is incorporated by reference herein for all purposes.

FIELD OF THE INVENTION

This invention relates to a method for improving the adhesion of monomeric and/or polymeric materials to keratinaceous substrates which substrates contain a major amount of alpha-keratin. An aspect of this invention relates to methods for reshaping essentially rigid keratinaceous surfaces such as nail plates wherein adhesion of the reshaping material is improved through the use of an adhesion-promoting treatment. Still another aspect of this invention relates to a kit for nail reshaping (e.g. nail extension) which includes an adhesion-promoting composition.

DESCRIPTION OF THE PRIOR ART

The reshaping (adornment, strengthening, repair, prosthetic extension, etc.) of essentially rigid, non-vascularized keratinaceous substrates such as hooves and nail plates (fingernail and toenail plates) in vivo in humans and animals has been a common practice for centuries. However, the development of suitable monomers and polymers for this purpose, particularly the acrylic-type monomers and polymers, has been a relatively recent development. The biologically distinguishing feature of relatively rigid, non-vascularized substrates such as toenail and fingernail plates is the presence of a large amount of alpha-keratin which contributes to the characteristics of the substrate. (Other keratinaceous substrates such as hair and feathers are relatively soft by comparison.) The reshaping material can either be cured in place on the essentially rigid, alpha-keratin-containing surface or can be pre-formed into a solid prosthesis which is typically pre-shaped to resemble a nail plate. Curable reshaping materials typically perform much better than pre-shaped, pre-cured prostheses and are often preferred by beauty salons, but both pre-cured and cured-in-situ repairs, adornments, prostheses, and the like can be easily dislodged and hence the keratinaceous surface is generally primed in some manner before the reshaping treatment. The primer is most typically an adhesion-promoting material or treatment such as an acidic or basic treatment or the application of a coating of a monomer, oligomer, or polymer which is also a member of the family of chemicals known in the art as "acrylics". A further purpose of the pre-treatment of the nail plate can be to harden or toughen it. See, for example, U.S. Pat. No. 4,547,363 (Joos), issued Oct. 15, 1985.

A commonly used acrylic priming or adhesion-promotion treatment involves the use of methacrylic acid or some similar unsaturated aliphatic carboxylic acid, which enables doughs or slurries of curable acrylic material (typically a mixture of free radical-polymerizable acrylic monomer and tiny, pre-cured acrylic beads) to adhere to a nail plate. Methacrylic acid in high concentrations can be damaging to biological surfaces and hence must be applied with great care. Accordingly, substitutes for methacrylic acid pre-treatments of keratinaceous surfaces have been sought, and a variety of such substitutes have been reported in the patent literature. See, for example, EP 0 325 038, published Jul. 26, 1989; U.S. Pat. No. 4,766,005 (Montgomery), issued Aug. 23, 1988; and DE-A 25 57 536, laid open Jul. 1, 1976.

Notwithstanding the constant search for pre-treatments which do not involve the use of methacrylic acid or similar unsaturated aliphatic carboxylic acids, there is still a need for adhesion-promoting treatments which will satisfy a very demanding set of criteria. These criteria include: highly effective wetting-out of the keratinaceous surface; safety and non-toxicity, even in high concentrations; low odor (it is particularly desirable to avoid the odors of aromatic solvents such as toluene or xylene); compatibility with acrylic monomers and polymers and preferably high free acrylic functionality (e.g. available —O—CO—C(R)=$CH_2$ groups, where R is H or, more preferably, a lower alkyl group); and high molecular weight and high viscosity and/or tack.

The arts of free radical initiation, polymerization of acrylic monomers (especially acrylic ester monomers), acrylic adhesives or primers, and the treatment of nail plates are all active and highly developed. It would be difficult to cite a comprehensive list of references from these arts, but the following references are believed to be representative: U.S. Pat. No. 4,766,005, EP 0 325 038, U.S. Pat. No. 4,547,363, and DE-A 25 57 536 (cited previously), and the following U.S. Pat. Nos. 3,347,954 (Bredereck et al), issued Oct. 17, 1967; 4,209,604 (Werber), issued Jun. 24, 1980; 4,288,221 (Engel), issued Sep. 8, 1981; 4,387,240 (Berg), issued Jun. 7, 1983; 4,413,108 (Jansen), issued Nov. 1, 1983; 4,534,839 (Schaefer), issued Aug. 13, 1985; 4,576,976 (Shaefer), issued Mar. 18, 1986; and 5,264,513 (Ikemura et al), issued Nov. 23, 1993.

SUMMARY OF THE INVENTION

It has now been discovered that the criteria for pre-treatment of keratinaceous surfaces, described above, can be met by applying a composition comprising (A) an organic, dipolar, aprotic liquid carrier and, uniformly distributed therethrough, (B) pyromellitic dianhydride glycerol dimethacrylate adduct (hereafter "PMGDM"), preferably the mono-adduct, which is believed to be made up of essentially one mole of pyromellitic acid (derived from its dianhydride), which, in tetracarboxylic acid form, has the formula II $$Ph[COOH]_4 \quad \text{(II)}$$

(where Ph is a benzene nucleus), linked to two moles of glycerol dimethacrylate, which has the structure III (III)

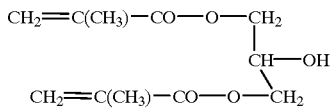

resulting in the compound $C_{32}H_{34}O_{16}$, believed to have the structure of formula I (I)

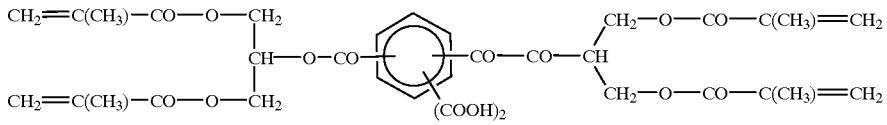

believed to exist in at least two isomers, the para-isomer being apparently the more stable one. Isomeric mixtures are preferred. Although higher adducts (even oligomers) can form from the starting materials, it is preferred to suppress or control the polymerization of the compounds of formulas II and III, so that the mono-adduct will predominate.

The preferred keratinaceous surfaces containing alpha-keratin are nail plates (fingernail and toenail plates), especially human nail plates. The preferred liquid carriers are lower ketones, lower aliphatic carboxylic acid esters, and mixtures of these compounds. These compounds can dissolve PMGDM, notwithstanding its high formula weight (674), so that the PMGDM will be uniformly distributed throughout the liquid carrier. (The term "lower", as in "lower aliphatic", means branched or straight-chain $C_1$–$C_6$-radicals, preferably $C_1$–$C_4$-radicals, in which one or more of the carbon atoms can be replaced with hetero-atoms such as O, N, or S but which are most typically hydrocarbon radicals.) Non-solvents or poor solvents for PMGDM, which provide uniform distribution of the PMGDM through fine suspension of this solid or semi-solid compound are less preferred.

The preferred pre-treatment is a key step in the conventional reshaping (adornment, strengthening, repair, prosthetic extension, etc.) of nail plates. Although a nail prosthesis can be pre-shaped and pre-cured before application to a nail plate, the preferred conventional treatment involves polymerization of the reshaping material in situ and hence involves a free radical-polymerizable acrylic monomer or, more typically, a dough or slurry comprising the acrylic monomer and solid particles of acrylic polymer. The curable or polymerizable acrylic reshaping material can be either radiation cured or "chemically" cured, so-called "chemical" cures being preferred. (In a "chemical" cure, the components of the reshaping material, after being brought together to form the dough or slurry contain a free radical polymerization catalyst/co-catalyst and no photoinitiator, hence the reshaping material does not need to be protected from light at any stage of its preparation or application, whereas radiation-curable compositions do contain a photoinitiator and can be pre-blended, but they must be protected from light at least until a short time prior to application to a nail plate surface.)

An aspect of this invention relates to kits for "chemically" cured systems which include the adhesion-promoting composition, the components of the reshaping material, and an applicator, preferably an elongated applicator such as paint brush.

DETAILED DESCRIPTION

The conventional reshaping treatments for nail plates are typically referred to as either "light cure" methods or "powder/liquid" methods, the "powder/liquid" methods being generally preferred. The "light cure" methods, as noted above, permit pre-mixing of ingredients, but nail treatment kits must be protected from light so that no premature curing occurs. The preferred photoinitiators used in "light cure" nail treatment kits (such as camphorquinone, see U.S. Pat. No. 4,534,839 [Shaefer], issued Aug. 13, 1985) are very sensitive to wavelengths in the visible spectrum, e.g. wavelengths of at least 400 or 450 nm, which can include the blue or, more typically, yellow portion of the visible spectrum. Although several known photoinitiators are very effective in the ultraviolet portion of the electromagnetic spectrum (e.g. wavelengths as low as about 200 nm), the method of this invention is used in vivo, and it is not desirable to expose human or animal tissue to ultraviolet light.

In the "powder/liquid" method, the "liquid" is typically a free-radical curable (polymerizable) acrylic monomer, e.g. an acrylic ester of the formula IV $$H_2C{=}C(R)—CO—O—R' \qquad (IV)$$

wherein R is hydrogen or, more preferably, lower alkyl (especially methyl or ethyl), and R' is a lower aliphatic group, especially lower alkyl which can be unsubstituted or substituted with hydroxy, lower alkoxy, or lower alkanoyloxy. Thus, preferred free-radical curable monomers include methyl methacrylate, ethyl methacrylate, ethyl ethacrylate, hydroxyethyl methacrylate, hydroxypropyl methacrylate, mixtures of these monomers, and the like. The curable monomer typically contains the free-radical polymerization co-catalyst or co-initiator, e.g. a tertiary amine.

The "powder" of the powder/liquid method is preferably particulate and comprises tiny beads of cured acrylic polymer, e.g. poly(methyl methacrylate), poly(ethyl methacrylate), mixtures of these polymers, and the like. The powder typically contains a free-radical initiator or catalyst (e.g. a peroxide) adsorbed or absorbed onto the surface of the solid polymeric particles.

An applicator, such as a paint brush, is dipped in the liquid and the powder, so that a doughy mass or slurry forms on the tip of the brush. This doughy mass can then be artfully shaped or sculpted on the keratinaceous surface. Prior to the application of the doughy mass or slurry to the keratinaceous substrate, the substrate is hardened and/or transformed into a highly adherent surface through a pretreatment. As noted above, the conventional pre-treatment, despite the advances in this art, is still the application of a thin film of methacrylic acid or methacrylic acid solution. Mechanical abrasion or roughening or the nail plate surface is also sometimes employed. The pre-treatment (adhesion promotion) treatment of this invention takes the place of the conventional methacrylic acid treatment.

Various key aspects of this invention will now be described in detail.

The PMGDM Adhesion-Promoting Composition

The chemical compound PMGDM is known and has been used in adhesive compositions which come into contact with biological surfaces, e.g. in dentistry. This compound has the CAS registry numbers 148019-46-9, which is specific to the 1,4- or para-isomer, and 146166-65-6, for the compound or mixture of compounds in which the isomer is not specified. That is, the latter registry number includes isomer mixtures as well as the individual isomers of the compound. In the context of this invention, there appears to be no advantage in isolating individual isomers, and, indeed, isomeric mixtures are preferred. The common or trivial name pyromellitic dianhydride glycerol dimethacrylate adduct corresponds to two Chemical Abstract names, which are 1,2,4,5-benzenetetracarboxylic acid 1,4-bis((2-methyl-1-oxo-2-propenyl)oxy)-1-(((2-methyl-1-oxo-2-propenyl)oxy)methyl)ethyl)ester, which is the 1,4- or para isomer, and 1,2,4,5-benzenetetracarboxylic acid bis((2-methyl-oxo-2-propenyl)oxy)-1-(((2-methyl-1-oxo-2-propenyl)oxy)methyl)ethyl)ester, which compound name does not specify an isomer and hence can be any individual isomer or a mixture of isomers.

Because of its high formula weight, even the mono-adduct (the compound of formula I, described above) is a material of such high viscosity that it can be considered to be a solid or semi-solid. The compound of formula I has four free unsaturated radicals, i.e. radicals of the formula $$H_2C{=}C(CH_3){-}CO{-}O{-},$$

and each of these radicals can serve as a hook, so to speak, for chemically linking the compound to unsaturated radicals in acrylic monomers or polymers. The PMGDM molecule thus provides very strong adhesive bonding to substances such as nail-reshaping material.

The solid or semi-solid PMGDM is however difficult to apply in undiluted form. The usual commercial form of PMGDM is an essentially anhydrous solution of this compound in a dipolar, aprotic solvent such as a lower ketone or lower aliphatic carboxylic acid. Ethers (e.g. cyclic ethers such as tetrahydrofuran, dioxane, etc.) are less preferred as carrier liquids. The preferred lower ketones are acetone, methyl ethyl ketone, diethyl ketone, and the like, acetone being most preferred. The preferred aliphatic carboxylic acid esters are ethyl acetate, methyl acetate, propyl acetate, ethyl propionate, and the like, ethyl acetate being most preferred. Mixtures of the ester solvents or the ketone solvents and mixtures of esters with ketones can be used.

In the case of the lower ketone solvents, 5 to 90% by weight of PMGDM can be dissolved, partially or fully, resulting in a uniform distribution of PMGDM in the solvent or liquid carrier. The preferred clear solutions contain 40 to 60 weight-% PMGDM and are slightly yellow in color. The amount of water in these solutions is negligible (well below 1% by weight) and is probably attributable to the polar and water-compatible nature of the solvent. (To the extent that the solvent is hygroscopic, ambient water vapor can be absorbed into the solution.) A small amount (<10% by weight, based on the total weight of solution) of unreacted starting material can be present, and polymerization inhibitors, catalysts, and the like can be present in minor amounts.

The preparation of PMGDM has been reported in the literature and need not be described in detail. The preferred starting materials are pyromellitic dianhydride (II, dianhydride form) and glycerol dimethacrylate (compound III, structure given above) in the II:III molar ratio of approximately 1:2, e.g. (0.9–1.1):(1.9–2.1). The proportions of reactants can be selected to control or suppress polymerization, and, in any event, a polymerization inhibitor can be present in the reaction mixture. Preferred polymerization inhibitors are compatible organic compounds which are easily converted from a reduced state (e.g. an unsaturated cyclic compound such as a hydroquinone) to an oxidized state (e.g. a quinone). It is also preferred that one of the OH groups of the hydroquinone be etherified, as in the case of the mono-methyl ether of hydroquinone.

The two reactants can react rather completely in a suitable reaction medium at ordinary ambient temperatures or at moderately elevated temperatures (e.g. 40 to 75° C., but preferably not more than about 65° C.). When ordinary ambient temperatures (e.g. 10 to 35° C.) are used, the reaction generally takes many hours or even days to complete. Since the reaction is mildly exothermic, the reaction medium can heat itself to temperatures of at least 40 or 50° C., even if the starting temperature is 20 to 25° C. Cooling of the reaction mixture after formation of the product can result in the formation of PMGDM crystals, which is not desirable in this invention, since it is preferred to employ the PMGDM in solution.

Suitable reaction media include hydrocarbon solvents such as aromatic liquids, but essentially anhydrous, dipolar aprotic solvents are preferred. For example, when lower ketone solvents are used as the reaction medium, it is not necessary to isolate the product, and it can be containerized and shipped in its reaction medium. In addition to the polymerization inhibitor, the reaction medium can optionally contain a catalyst for the reaction, e.g. an amine catalyst. Under the proper conditions, yields in excess of 50% of theory are obtained.

One commercially available form of PMGDM is an acetone solution containing about 50% solids, roughly 80% by weight of these solids being PMGDM. This available form of PMGDM is suitable for use in this invention, without modification, as an adhesion promoter for keratinaceous surfaces. It is not necessary for the solution of PMGDM to exhibit either acidic or basic behavior. To the extent that the pH of the solution can be measured realistically in the absence of solvents which assist in the dissociation of Brönsted acids and bases, the pH of the solution need not be in the strongly acid range (pH<4) or in the noticeably basic range (pH>8). The pH of an adhesion promoter of this invention can be compatible with skin (e.g. from 5 to 8). The solution can be applied to the keratinaceous surface with an applicator (e.g. a paint brush), and at normal ambient temperature and pressure the solvent (e.g. acetone) will evaporate off completely or almost completely in a fairly short time, leaving behind a solid or semi-solid residue which tends to be tacky under normal ambient conditions. The conventional reshaping procedure can then begin.

Reshaping Procedures

The various reshaping procedures (e.g. the light-cure method and the powder/liquid method) have been described previously and in any event are essentially conventional. However, it should be noted that, in the case of nail plate reshaping, it is not always necessary to replace completely a prosthesis which has already been applied. The partial replacement of a nail extension prosthesis is sometimes called "filling". This partial replacement procedure is typically necessitated by the natural growth of the nail plate. A proximal portion of the prosthesis extending distally from the cuticle is removed, exposing the proximal part of the nail plate. The exposed portion of the nail plate is then treated with the adhesion promoter of this invention, and nail reshaping material is then applied to the dried film of PMGDM.

Nail plates reshaped in accordance with this invention can be further coated with clear or pigmented lacquers, nail polishes, and the like. The lacquer or nail polish can be applied, if desired, to only the proximal part of the nail prosthesis, leaving the tip of the prosthesis uncoated. Alternatively, the tip of the prosthesis can be coated with a white or clear lacquer.

Kits

The preferred nail reshaping kits of this invention include an applicator, preferably an elongated applicator such as a paint brush, the adhesion-promoting composition of this invention, and the components for the powder/liquid method of nail extension. It is preferred that the powder and, especially, the curable liquid monomer be supplied in sealed containers which can be opened with the applicator. That is, each sealed container is provided with a closure having a moveable member (e.g. a spring-loaded or flexible disc) covering up an aperture in the closure. When this valve-like member is depressed with the tip of the applicator, the tip of the applicator picks up powder or liquid. As a result, a doughy mass or slurry comprising powder and liquid forms on the tip of the applicator and can be applied to the primed nail plate surface.

What is claimed is:

1. A method for improving adhesion of a synthetic monomeric or polymeric material to a keratinaceous substrate comprising alpha-keratin, comprising the step of: applying to said keratinaceous substrate an adhesion-promoting composition comprising (A) an organic, dipolar, aprotic liquid carrier and, uniformly distributed throughout said organic, dipolar, aprotic liquid carrier, (B) pyromellitic dianhydride glycerol dimethacrylate adduct.

2. The method according to claim 1, wherein said keratinaceous substrate is a nail plate.

3. The method according to claim 2, wherein the synthetic monomeric material comprises a free radical-polymerizable acrylic monomer.

4. The method according to claim 2, wherein said component B of said adhesion-promoting composition comprises a mixture of isomers of pyromellitic dianhydride glycerol dimethacrylate adduct, said pyromellitic dianhydride glycerol dimethacrylate adduct being essentially free of polymeric forms of pyromellitic dianhydride glycerol dimethacrylate adduct.

5. The method according to claim 2, wherein said organic, dipolar, aprotic liquid carrier comprises a lower aliphatic ketone.

6. The method according to claim 5, wherein said lower aliphatic ketone comprises acetone.

7. The method according to claim 2, wherein said organic, dipolar, aprotic, liquid carrier comprises a lower aliphatic carboxylic acid ester.

8. The method according to claim 1, comprising the following steps:

a. applying said adhesion-promoting composition to said keratinaceous substrate until at least a portion of the keratinaceous substrate is essentially coated with said adhesion-promoting composition, thereby providing an adhesion-promoting film on said keratinaceous substrate, b. permitting at least of portion of said organic, dipolar, aprotic liquid carrier of said adhesion-promoting film to evaporate under normal ambient conditions, c. applying a free-radical polymerizable acrylic monomer or a solid, particulate polymerized acrylic ester or a combination of said free-radical polymerizable acrylic monomer and said solid, particulate polymerized acrylic ester to said adhesion-promoting film.

9. A method for reshaping a nail plate with an acrylic monomer, an acrylic polymer, or a combination of acrylic monomer and acrylic polymer, comprising:

a. applying to the nail plate an adhesion-promoting composition comprising (A) an organic, dipolar, aprotic liquid carrier and (B) a plurality of isomers of pyromellitic dianhydride glycerol dimethacrylate adduct, until at least a portion of said nail plate is provided with an adhesion-promoting film, b. permitting at least a portion of said organic, dipolar, aprotic liquid carrier of said adhesion-promoting film to evaporate under normal ambient conditions, and c. applying a free-radical polymerizable acrylic monomer or a solid, polymerized acrylic ester or a combination of said free-radical polymerizable acrylic monomer and said solid, polymerized acrylic ester to said adhesion-promoting film.

10. The method according to claim 9, wherein the nail plate has previously been reshaped with an existing nail prosthesis, wherein a portion of said nail prosthesis is removed to expose the underlying nail plate, and wherein, in said step a, said adhesion-promoting composition is applied to the resulting exposed portion of the nail plate.

11. The method according to claim 9, wherein a free-radical polymerizable acrylic monomer containing a photo-initiator is applied to said adhesion-promoting film, and the acrylic monomer is polymerized in place on said adhesion-promoting film with the aid of radiation.

12. The method according to claim 9, wherein a combination comprising free-radical polymerizable acrylic monomer, solid, polymerized acrylic ester, and a free radical-initiation catalyst is applied to said adhesion-promoting film, and the free-radical polymerizable acrylic monomer is polymerized in place on said adhesion-promoting film with the aid of the free radical-initiation catalyst.

13. A kit for the reshaping of a nail plate, comprising:

i. an applicator for applying materials to a nail plate, ii. an adhesion-promoting composition comprising an organic, dipolar, aprotic liquid carrier, and, uniformly distributed therethrough, pyromellitic dianhydride glycerol dimethacrylate adduct, iii. a liquid acrylic monomer containing a free-radical initiation catalyst, iv. a particulate solid acrylic polymer containing a free-radical initiation co-catalyst.

14. A kit according to claim 13, wherein said liquid acrylic monomer is contained in a closed container having a closure provided with an opening sealed by a moveable closure element which can be opened by pressing upon it with the tip of an elongated applicator.

15. The method according to claim 1, wherein the pyromellitic dianhydride glycerol dimethacrylate adduct is an isomeric mixture.

16. The method according to claim 15, wherein said isomeric mixture contains a plurality of isomers, including the para isomer of pyromellitic dianhydride glycerol dimethacrylate adduct.

* * * * *